US011633841B2

(12) United States Patent
Tsai et al.

(10) Patent No.: US 11,633,841 B2
(45) Date of Patent: Apr. 25, 2023

(54) METHOD FOR CONTROLLING NAIL-STRIKING OPERATION OF AN ELECTRIC NAIL GUN, AND ELECTRIC NAIL GUN IMPLEMENTING THE SAME

(71) Applicant: BASSO INDUSTRY CORP., Taichung (TW)

(72) Inventors: Cheng-En Tsai, Taichung (TW); Chun-Min Shih, Taichung (TW)

(73) Assignee: Basso Industry Corp., Taichung (TW)

( * ) Notice: Subject to any disclaimer, the term of this patent is extended or adjusted under 35 U.S.C. 154(b) by 339 days.

(21) Appl. No.: 16/897,097

(22) Filed: Jun. 9, 2020

(65) Prior Publication Data

US 2020/0391367 A1 Dec. 17, 2020

(30) Foreign Application Priority Data

Jun. 11, 2019 (TW) ..... 108120132

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06; B25C 1/008
See application file for complete search history.

(56) References Cited

U.S. PATENT DOCUMENTS

2005/0029323 A1* 2/2005 Shima ..... B25C 1/008 227/130
2008/0017689 A1* 1/2008 Simonelli ..... B25C 1/06 227/132
2009/0321492 A1* 12/2009 Shima ..... B25C 1/008 227/2
2012/0104069 A1* 5/2012 Chien ..... B25C 1/008 227/2
2012/0104070 A1* 5/2012 Wu ..... B25C 1/06 227/8
2014/0263535 A1* 9/2014 Rajani ..... B25C 1/06 173/1
2016/0207185 A1* 7/2016 Garber ..... B25C 1/008
2020/0398411 A1* 12/2020 Ootsuka ..... B25C 1/04
2020/0398412 A1* 12/2020 Yasutomi ..... B25C 1/008
2021/0229249 A1* 7/2021 Ootsuka ..... B25C 1/008
2021/0237241 A1* 8/2021 Harada ..... B25C 1/047
2022/0161404 A1* 5/2022 Lim ..... B25C 1/06

FOREIGN PATENT DOCUMENTS

TW I401143 B 7/2013

* cited by examiner

*Primary Examiner* — Anna K Kinsaul
*Assistant Examiner* — Himchan Song
(74) *Attorney, Agent, or Firm* — Burris Law, PLLC

(57) ABSTRACT

A method for controlling a nail-striking operation of an electric nail gun is proposed. The electric nail gun includes a control module and at least one switch. The at least one switch outputs a first switch signal that has a first voltage and a second switch signal that has a second voltage when triggered. The control module set a flag that corresponds to the at least one switch to a predetermined state upon determining that a striking condition is met. The striking condition includes that, for each of the at least one switch, the first switch signal has the first voltage and the second switch signal has the second voltage.

11 Claims, 7 Drawing Sheets

METHOD FOR CONTROLLING NAIL-STRIKING OPERATION OF AN ELECTRIC NAIL GUN, AND ELECTRIC NAIL GUN IMPLEMENTING THE SAME

CROSS-REFERENCE TO RELATED APPLICATION

This application claims priority of Taiwanese Invention Patent Application No. 108120132, filed on Jun. 11, 2019.

FIELD

The disclosure relates to an electric nail gun, and more particularly to a method for controlling nail-striking operation of an electric nail gun.

BACKGROUND

Referring to FIG. 1, Taiwanese Patent No. I401143 discloses a conventional electric nail gun 1 that includes a kinetic power unit 11 to generate kinetic energy, an impact unit 13 to strike a nail, a transmission unit 12 to transmit the kinetic energy from the kinetic power unit 11 to the impact unit 13 so as to make the impact unit 13 strike a nail, a first electric control unit 14 to activate the kinetic power unit 11 to generate kinetic energy, a second electric control unit 15 to activate the transmission unit 12 to transmit the kinetic energy, a trigger unit 16 operable to trigger the first electric control unit 14, and a safety member 17 to abut against an article into which the electric nail gun 1 is to drive a nail and to trigger the second electric control unit 15. By controlling an order of actuating the trigger unit 16 and the safety member 17, the conventional electric nail gun 1 can selectively operate in a single shot mode or a continuous shooting mode.

Since an electronic-controlled switch (e.g., the first and second electric control units 14, 15) may malfunction because of environmental interference, safety standards for an electric nail gun require that the electric-controlled switch be designed to have fault tolerance, such as using two first electric control units 14 and two second electric control units 15 in the electric nail gun 1, so as to enhance safety. However, such design is disadvantageous in space arrangement because of use of more components.

SUMMARY

Therefore, an object of the disclosure is to provide an electric nail gun that is configured to meet the safety standard without adding duplicate components. The electric nail gun includes a control module and at least one switch that is electrically connected to the control module, and implements a method for controlling a nail-striking operation thereof. The control module has a flag that corresponds to the at least one switch.

According to the disclosure, the method includes steps of: A) by the control module, receiving a first switch signal and a second switch signal from each of the at least one switch, and determining whether a striking condition is met based on the first switch signal and the second switch signal received from each of the at least one switch, wherein each of the at least one switch is configured to output, when being triggered, the first switch signal having a first voltage and the second switch signal having a second voltage that is different from the first voltage, and wherein the striking condition includes that, for each of the at least one switch, the first switch signal has the first voltage and the second switch signal has the second voltage, which indicates that each of the at least one switch is triggered; B) by the control module, upon determining that the striking condition is met, setting the flag to a first state indicating that the nail-striking operation is allowed; C) by the control module, upon determining that the striking condition is not met, setting the flag to a second state indicating that the nail-striking operation is not allowed; and D) by the control module, causing the electric nail gun to perform the nail-striking operation when each of the flag is set to the first state.

According to the disclosure, the electric gun includes a gun body, an electric power source unit mounted to the gun body, a kinetic power unit mounted to the gun body, and an electric control unit mounted to the gun body. The electric power source unit is configured to provide electric power for operation of the electric nail gun. The kinetic power unit is electrically connected to the electric power source unit for receiving the electric power therefrom, and is configured to perform a nail-striking operation. The electric control unit is electrically connected to the electric power source unit and the kinetic power unit, and includes at least one switch and a control module. The control module is electrically connected to the at least one switch, and has a flag that corresponds to the at least one switch. Each of the at least one switch has a first node to output a first switch signal, a second node to output a second switch signal, and a common node operable to make electric connection with one of the first node and the second node. Each of the at least one switch is configured such that, when being triggered to make electric connection between the second node and the common node, the first switch signal has a first voltage and the second switch signal has a second voltage that is different from the first voltage. The control module receives the first switch signal and the second switch signal from each of the at least one switch, and is configured to perform steps of the method for controlling the nail-striking operation according to this disclosure.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
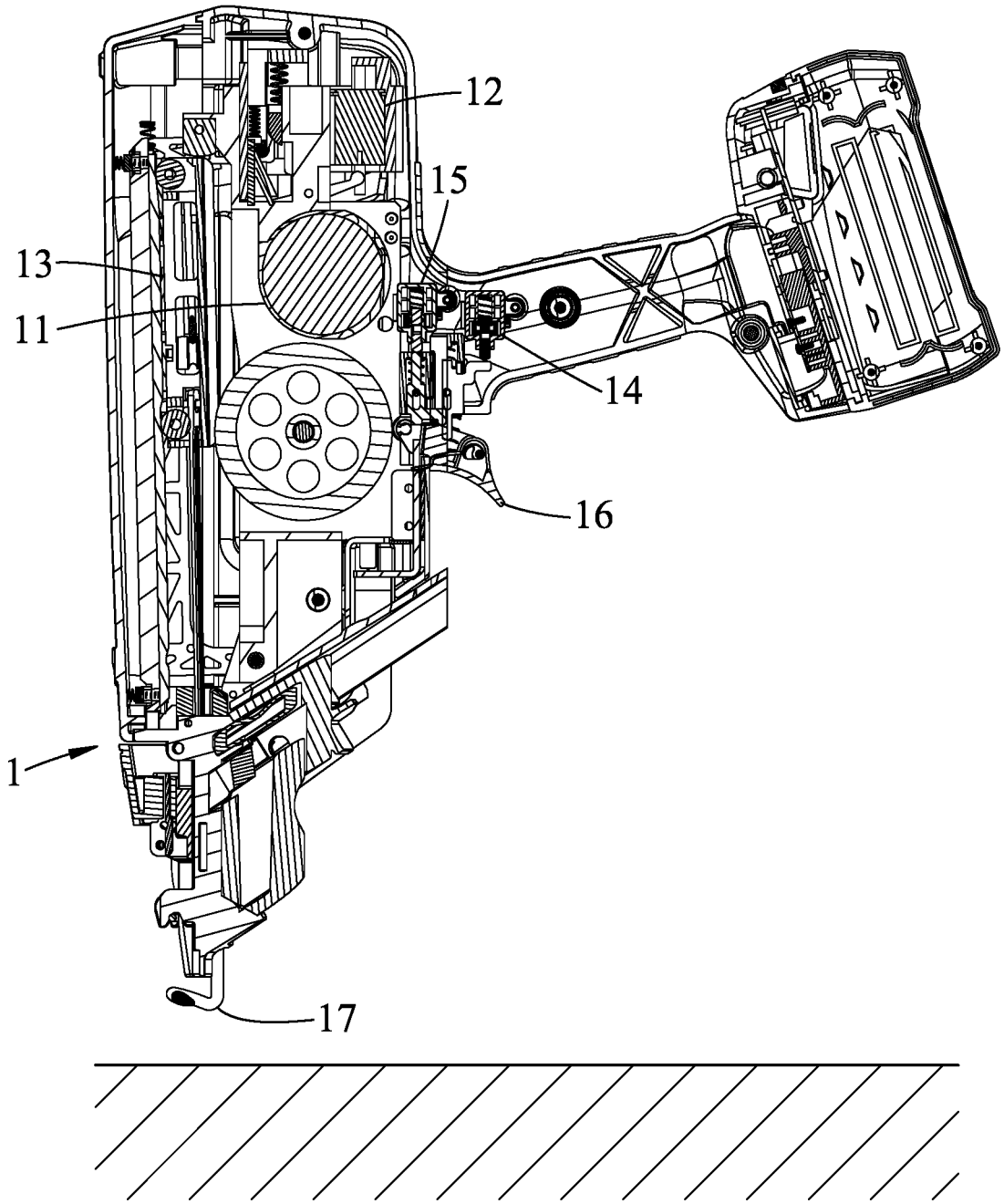
FIG.1 PRIOR ART
FIG. 1 is a sectional view illustrating a conventional electric nail gun disclosed in Taiwanese Patent No. I401143.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
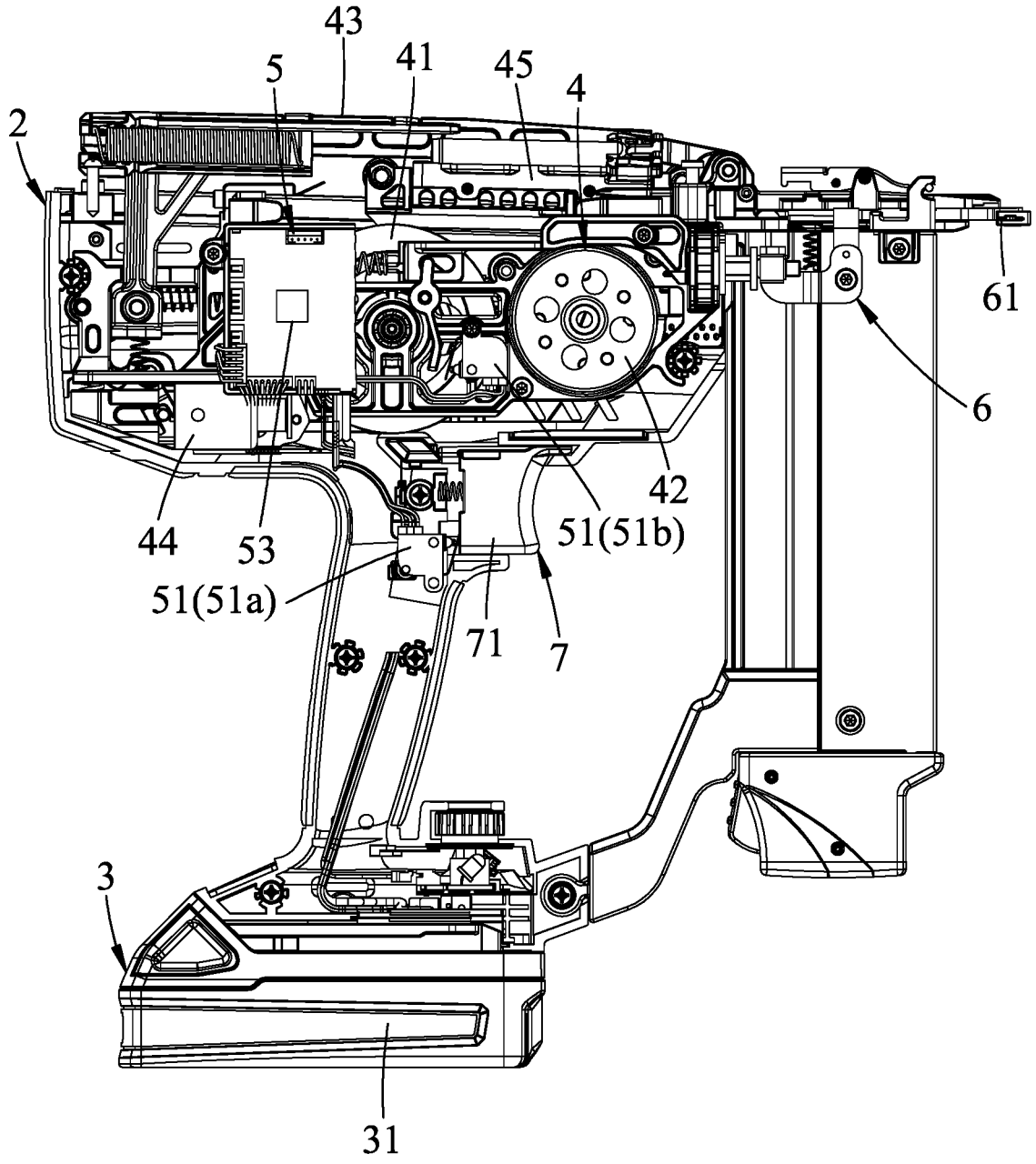
FIG. 2 is a sectional view illustrating an embodiment of an electric nail gun according to this disclosure.
Figure 3:
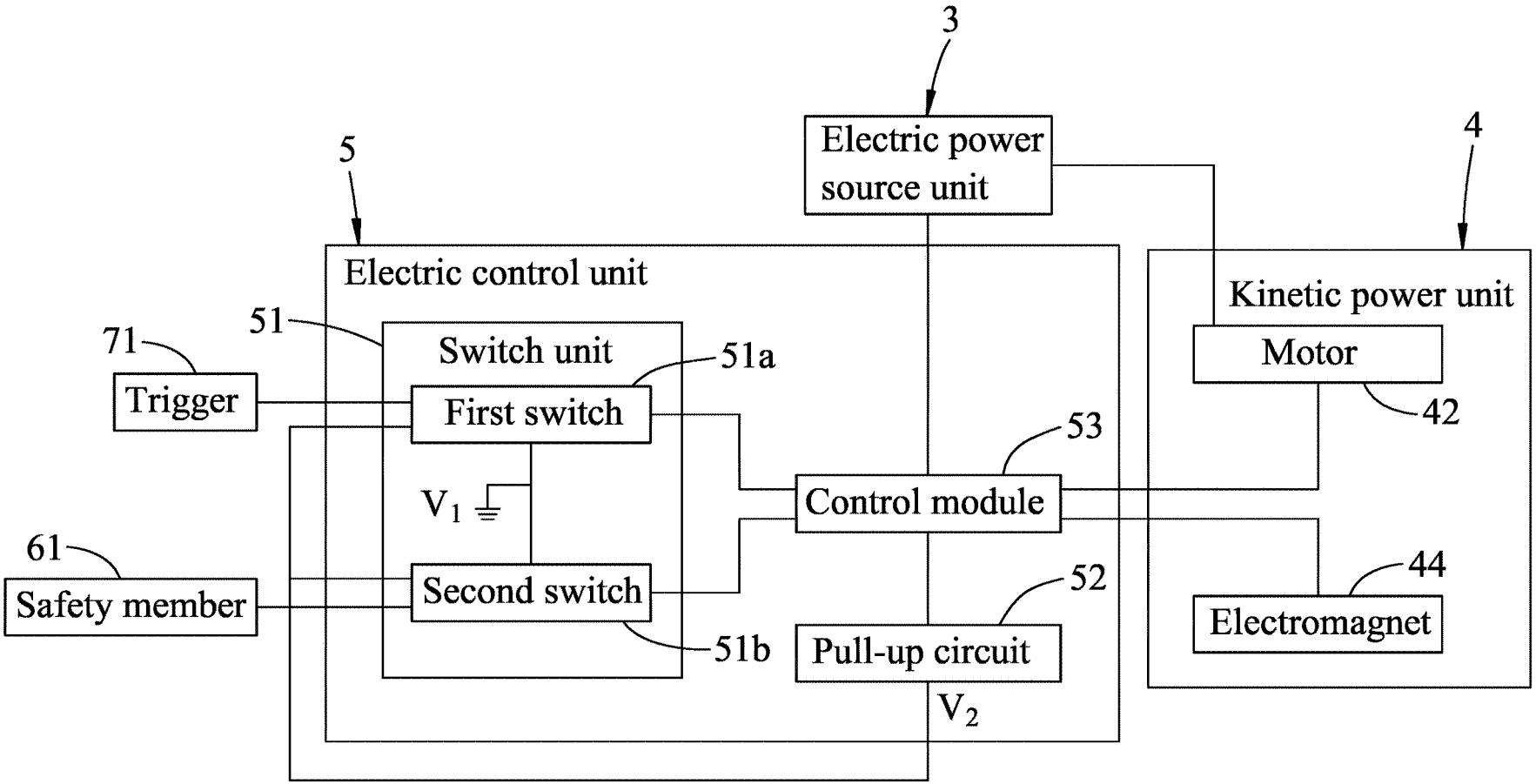
FIG. 3 is a block diagram illustrating the embodiment.
Figure 4:
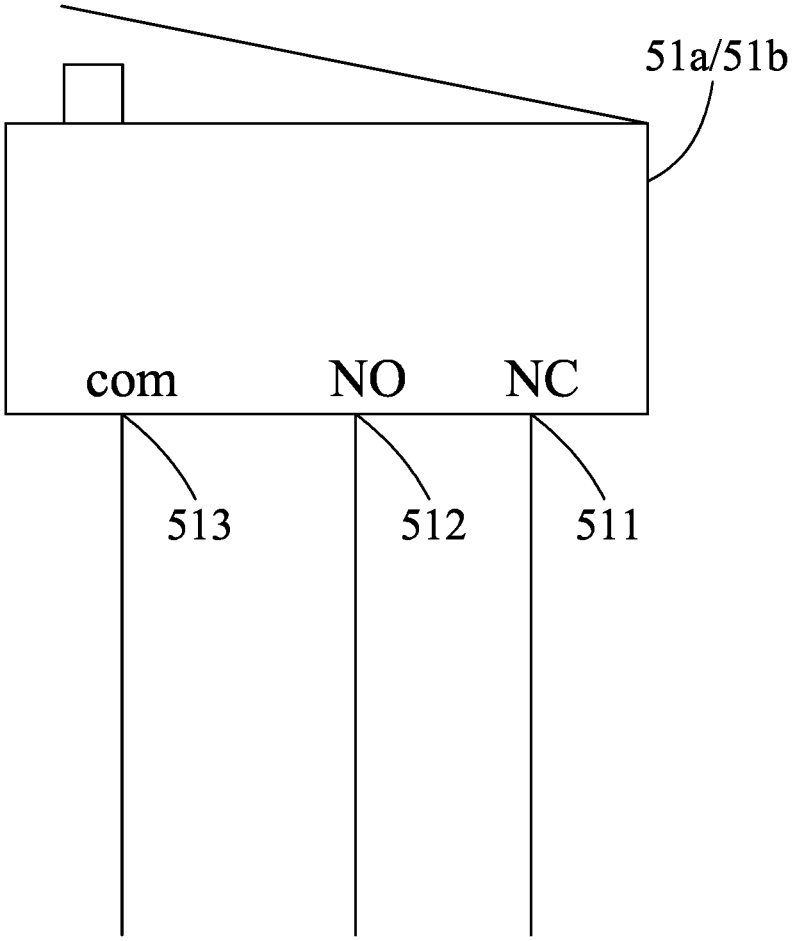
FIG. 4 is a schematic diagram illustrating a micro switch used in the embodiment.

Referring to FIGS. 2 to 4, an embodiment of an electric nail gun according to this disclosure includes a gun body 2, an electric power source unit 3, a kinetic power unit 4, an electric control unit 5, a safety unit 6 and a trigger unit 7.

The electric power source unit 3 is mounted to the gun body 2, and is configured to provide electric power for operation of the electric nail gun. In this embodiment, the electric power source unit 3 includes a battery 31 that stores electric power therein, but this disclosure is not limited in this respect.

The kinetic power unit 4 is mounted to the gun body 2, and is configured to perform a nail-striking operation. In this embodiment, the electric nail gun is exemplified as a flywheel-type nail gun, and the kinetic power unit 4 includes a flywheel 41 pivotally mounted to the gun body 2, a motor 42 electrically connected to the electric power source unit 3 for receiving the electric power therefrom and configured to drive rotation of the flywheel 41, a swing arm 43 pivotally mounted to the gun body 2, an electromagnet 44 disposed to control a distance between the swing arm 43 and the flywheel 41, and an impact member 45 slidable along the swing arm 43. The impact member 45 is capable of contacting the flywheel 41 so that the impact member 45 can be moved by the flywheel 41 to strike a nail (not shown). It is noted that the electric nail gun in this disclosure is not limited to a flywheel-type nail gun, and may be other types of electric nail guns in other embodiments, such as a pneumatic nail gun. Accordingly, the kinetic power unit 4 may include other components for performing the nail-striking operation, and is not limited to those of the embodiment.

Figure 5:
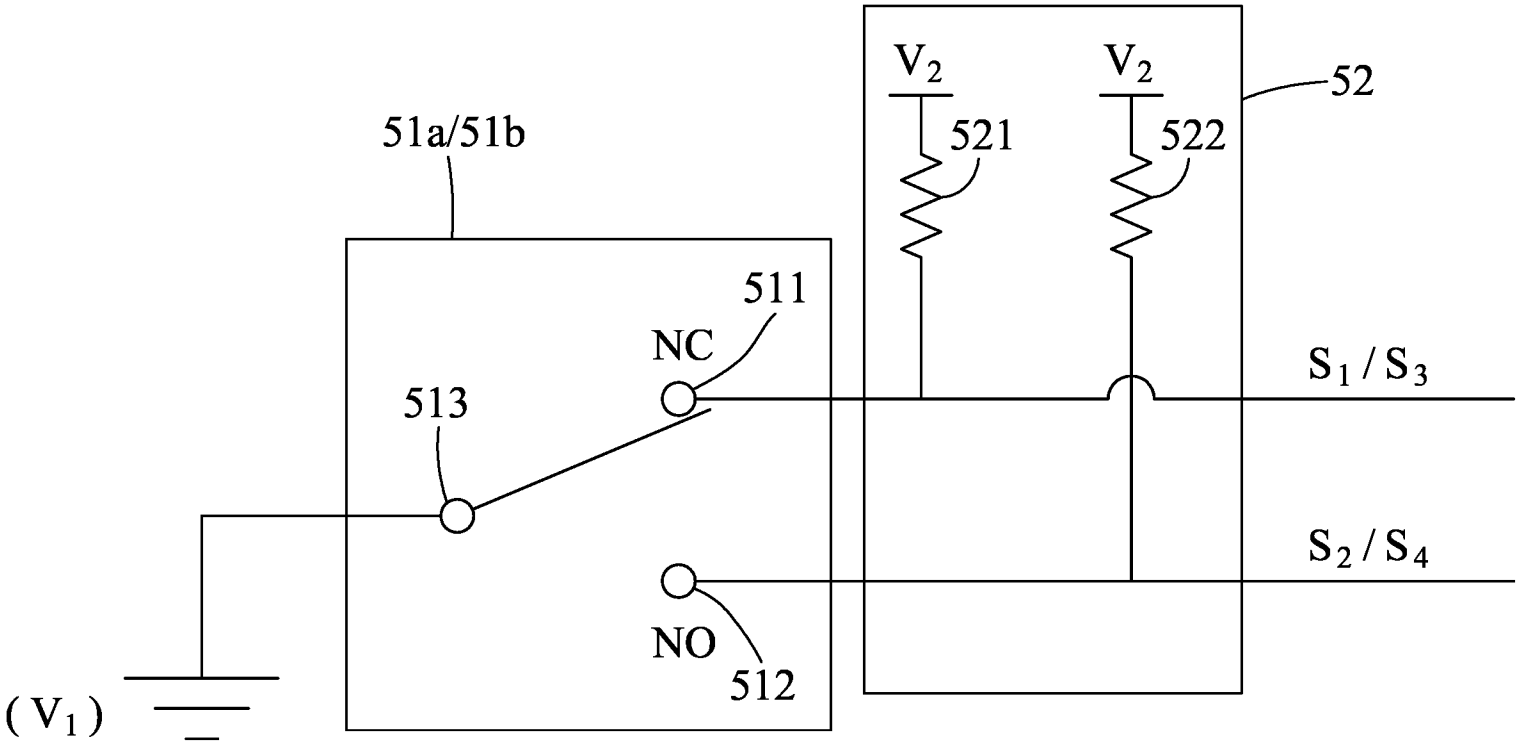
FIG. 5 is a schematic diagram illustrating connection between the micro switch and a pull-up circuit of the embodiment when the micro switch is not triggered.
Figure 6:
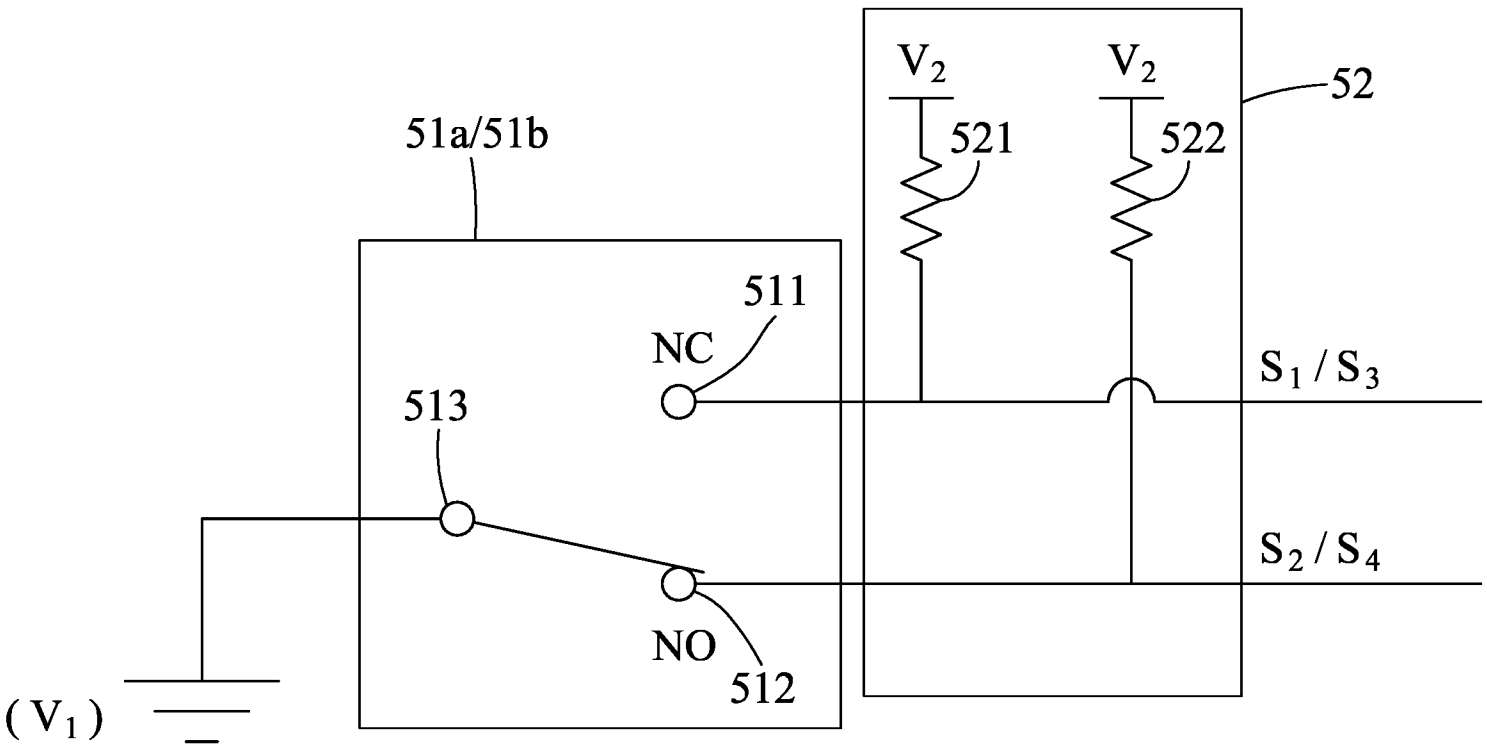
FIG. 6 is a schematic diagram illustrating connection between the micro switch and the pull-up circuit when the micro switch is triggered.

Referring to FIGS. 2, 3 and 5, the electric control unit 5 is mounted to the gun body 2, and is electrically connected to the electric power source unit 3, the motor 42 and the electromagnet 44, and includes a switch unit 51 that contains at least one switch, a pull-up circuit 52 and a control module 53. In this embodiment, the switch unit 51 includes a first switch 51*a* and a second switch 51*b* that are electrically connected to the control module 53 in this embodiment. The control module 53 has a flag (e.g., a Boolean flag) that corresponds to the at least one switch.

In this embodiment, each of the first switch 51*a* and second switch 51*b* is a miniature snap-action switch (also known as a micro switch), and has a first node 511, a second node 512 and a common node 513. The first node 511 and the second node 512 of each of the first switch 51*a* and the second switch 51*b* have a first voltage level and a second voltage level, respectively. The common nodes 513 of the first switch 51*a* and the second switch 51*b* are to receive a first voltage $V_1$, which is a ground voltage in this embodiment. In this embodiment, for each of the first switch 51*a* and the second switch 51*b*, the first node 511 is a normally-closed node that is electrically connected to the common node 513 when the switch 51*a*/51*b* is not triggered, and the second node 512 is a normally-open node that is electrically connected to the common node 513 when the switch 51*a*/51*b* is triggered.

The pull-up circuit 52 is electrically connected to the first nodes 511 and the second nodes 512 of the first switch 51*a* and the second switch 51*b*. In this embodiment, the pull-up circuit 52 includes, for each of the first switch 51*a* and the second switch 51*b*, a first resistor 521 electrically connected between the first node 511 and a voltage source (e.g., a voltage regulator, which is not shown in the drawings) that provides a second voltage $V_2$, and a second resistor 522 electrically connected between the second node 512 and the voltage source. The second voltage $V_2$ is different from the first voltage $V_1$. In this embodiment, the second voltage $V_2$ (e.g., 5 volts) is greater than the first voltage $V_1$ (e.g., 0 volts), but this disclosure is not limited in this respect.

Accordingly, during normal operation of the switch 51*a*/51*b*, the first voltage level at the first node 511 thereof is equal to the first voltage $V_1$ and the second voltage level at the second node 512 thereof is equal to the second voltage $V_2$ when the switch 51*a*/51*b* is not triggered, and the first voltage level at the first node 511 thereof is equal to the second voltage $V_2$ and the second voltage level at the second node 512 thereof is equal to the first voltage $V_1$ when the switch 51*a*/51*b* is triggered.

The safety unit 6 includes a safety member 61 that is movably mounted to the gun body 2 and that is configured to abut against an article into which the electric nail gun is to drive a nail. The safety member 61 is connected to the second switch 51*b*, and is configured to make the common node 513 of the second switch 51*b* electrically connect to one of the first node 511 and the second node 512 of the second switch 51*b*. Specifically, the safety member 61 is configured to trigger the second switch 51*b* (i.e., to make the common node 513 electrically connect to the second node 512) when the safety member 61 abuts against an article.

The trigger unit 7 includes a trigger 71 that is pivotally mounted to the gun body 2, that is connected to the first switch 51*a*, and that is configured to make the common node 513 of the first switch 51*a* electrically connect to one of the first node 511 and the second node 512 of the first switch 51*a*. Specifically, the trigger 71 is configured to trigger the first switch 51*a* (i.e., to make the common node 513 electrically connect to the second node 512) when the trigger 71 is pressed.

The control module 53 is electrically connected to the first nodes 511 and the second nodes 512 of the first switch 51*a* and the second switch 51*b* for detecting the first and second voltage levels at the first node 511 and the second node 512 of each of the first switch 51*a* and the second switch 51*b*. The first and second voltage levels detected at the first node 511 and the second node 512 of each of the first switch 51*a* and the second switch 51*b* serve respectively as a first switch signal $S_1$ and a second switch signal $S_2$ for the corresponding one of the first switch 51*a* and the second switch 51*b*, and are to be received by the control module 53. When a striking condition that is related to the first and second switch signals $S_1$, $S_2$ received from the first switch 51*a* and the second switch 51*b* is met, the control module 53 controls the motor 42 to drive rotation of the flywheel 41, and controls the electromagnet 44 to induce movement of the swing arm 43. Then, the swing arm 43 brings the impact member 45 into contact with the flywheel 41, so that the flywheel 41 moves the impact member 45 to strike a nail, thereby completing the nail-striking operation.

Figure 7:
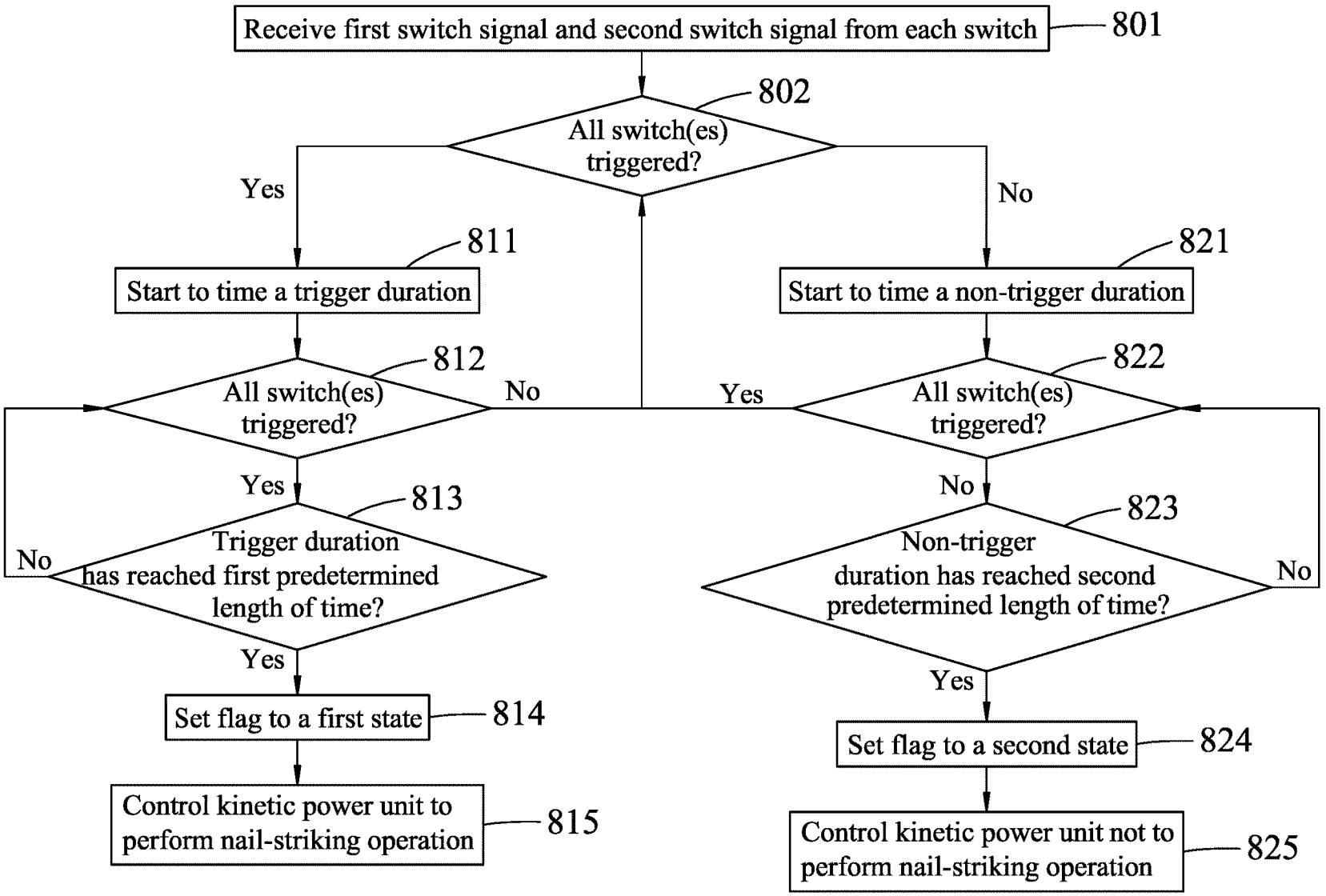
FIG. 7 is a flow chart illustrating steps of an embodiment of a method for controlling a nail-striking operation of the electric nail gun according to this disclosure.

Further referring to FIG. 7, a flow chart is shown to illustrate an embodiment of a method for controlling the nail-striking operation of the electric nail gun. In this embodiment, the control module 53 may be a microcontroller that is programmed to perform the following steps.

In step 801, the control module 53 receives the first switch signal $S_1$ and the second switch signal $S_2$ from each of the first switch 51*a* and the second switch 51*b*.

In step 802, the control module 53 periodically determines whether each of the first switch 51*a* and the second switch 51*b* is triggered based on the first switch signal $S_1$ and the second switch signal $S_2$ received from the first or second switch 51*a*, 51*b* at a predetermined time interval. The predetermined time interval may be between 0.5 ms and 1.5 ms, but this disclosure is not limited in this respect. Specifically, the predetermined time interval is 1 ms in this embodiment. When, for each of the first switch 51*a* and the second switch 51*b*, the first switch signal $S_1$ has the second voltage $V_2$ and the second switch signal $S_2$ has the first voltage $V_1$, the control module 53 determines that the first switch 51*a* and the second switch 51*b* are all (both) triggered, and the flow goes to step 811. Otherwise, the flow goes to step 821.

In step 811, the control module 53 starts to time a trigger duration that the simultaneous triggering of the first switch 51*a* and the second switch 51*b* lasts.

In step 812, the control module 53 continues to determine whether both of the first switch 51*a* and the second switch 51*b* are triggered based on the first switch signals $S_1$ and the second switch signals $S_2$ received from the first switch 51*a* and the second switch 51*b* during the timing of the trigger duration. The flow goes to step 813 when the determination made in step 812 is affirmative.

In step 813, the control module 53 determines whether the trigger duration has reached a first predetermined length of time. The first predetermined length of time may be between 15 ms and 25 ms, but this disclosure is not limited in this respect. Specifically, the first predetermined length of time is 20 ms in this embodiment. When the trigger duration has reached the first predetermined length of time, the control module 53 determines that the striking condition is met, and the flow goes to step 814 (i.e., the striking condition in this embodiment refers to a condition that the determinations made respectively in step 802, step 812 and step 813 are all affirmative). Otherwise, the flow goes back to step 812.

In step 812, when the control module 53 determines that any one of the first switch 51*a* and second switch 51*b* is not triggered (e.g., the trigger 71 and/or the safety member 61 is released) while the the trigger duration has not reached the first predetermined length of time, the flow goes back to step 802.

In step 814, the control module 53 sets the flag to a first state (e.g., having a logic value "1") which indicates that the nail-striking operation is allowed, and the flow goes to step 815.

In step 815, the control module 53 controls the kinetic power unit 4 to perform the nail-striking operation.

In step 821, the control module 53 starts to time a non-trigger duration during which anyone of the first switch 51*a* and the second switch 51*b* is not triggered.

In step 822, the control module 53 continues to determine whether each of the first switch 51*a* and the second switch 51*b* is triggered (or whether any one of the first switch 51*a* and the second switch 52*b* is not triggered) based on the first switch signal $S_1$ and the second switch signal $S_2$ received from each of the first switch 51*a* and the second switch 51*b* during the timing of the non-trigger duration. The flow goes to step 823 when it is determined that not both of the first switch 51*a* and the second switch 51*b* are triggered, and goes back to step 802 when otherwise.

In step 823, the control module 53 determines whether the non-trigger duration has reached a second predetermined length of time. The second predetermined length of time may be between 15 ms and 25 ms, and may be either the same as or different from the first predetermined length of time, but this disclosure is not limited in this respect. Specifically, the second predetermined length of time is 20 ms in this embodiment. When the non-trigger duration has reached the second predetermined length of time, the control module 53 determines that the striking condition is not met, and the flow goes to step 824. Otherwise, the flow goes back to step 822.

In step 822, when the control module 53 determines that both of the first switch 51*a* and the second switch 51*b* are triggered while the the non-trigger duration has not reached the second predetermined length of time, the flow goes back to step 802.

In step 824, the control module 53 sets the flag to a second state (e.g., having a logic value "0") which indicates that the nail-striking operation is not allowed, and the flow goes to step 825.

In step 825, the control module 53 controls the kinetic power unit 4 not to perform the nail-striking operation.

When the following abnormal conditions occur, the abovementioned flow may disable the nail-striking operation of the electric nail gun. In a first abnormal condition where the first node 511 of the switch 51*a*/51*b* is abnormally short to ground even when the switch 51*a*/51*b* is triggered (i.e., when the common node 513 is connected to the second node 512), both of the first switch signal $S_1$ and the second switch signal $S_2$ will have the first voltage $V_1$, so that the striking condition will not be met, and the nail-striking operation will not be performed. In a second abnormal condition where the first node 511 of the switch 51*a*/51*b* is abnormally short with the second node 512 of the switch 51*a*/51*b*, both of the first switch signal $S_1$ and the second switch signal $S_2$ will have the first voltage $V_1$ at all times, and the nail-striking operation will not be performed.

It is noted that, in other embodiments, the electric nail gun may include only one switch or more switches to be used in the abovementioned flow for controlling the nail-striking operation, and the disclosure is not limited to the embodiment.

In summary, the embodiment according to this disclosure is advantageous in that each switch outputs two switch signals where a specific combination of voltages is used to establish a double checking mechanism to check if the switch works normally, so it is not required to use two switches that have the same connection (in the embodiments, the first and second switches 51*a* and 51*b* are connected respectively to the trigger unit 7 and the safety unit 6 in the electric nail gun, and do not have the same connection) for the fault tolerance. Material cost may thus be saved and the space arrangement can be improved while the safety in use is promoted.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A method for controlling a nail-striking operation of an electric nail gun, the electric nail gun including a control module, and at least one switch that is electrically connected to the control module, the control module having a flag that corresponds to the at least one switch, the method comprising steps of:

A) by the control module, receiving a first switch signal and a second switch signal from each of the at least one switch, and determining whether a striking condition is met based on the first switch signal and the second switch signal received from each of the at least one switch, wherein each of the at least one switch is configured to output, when being triggered, the first switch signal having a first voltage and the second switch signal having a second voltage that is different from the first voltage, wherein the striking condition includes that, for each of the at least one switch, the first switch signal has the first voltage and the second switch signal has the second voltage, which indicates that all of the at least one switch is triggered;

B) by the control module, upon determining that the striking condition is met, setting the flag to a first state indicating that the nail-striking operation is allowed;

C) by the control module, upon determining that the striking condition is not met, setting the flag to a second state indicating that the nail-striking operation is not allowed; and D) by the control module, causing the electric nail gun to perform the nail-striking operation when the flag is set to the first state.

2. The method of claim 1, wherein step A) includes sub-steps of:

A-1) determining whether all of the at least one switch is triggered based on the first switch signal and the second switch signal received from each of the at least one switch;

A-2) upon determining that all of the at least one switch is triggered in sub-step A-1), timing a trigger duration that the triggering of all of the at least one switch lasts, and continuing to determine whether all of the at least one switch is triggered based on the first switch signal and the second switch signal received from each of the at least one switch during the timing of the trigger duration;

A-3) when the trigger duration timed in sub-step A-2) reaches a first predetermined length of time, determining that the striking condition is met; and A-4) upon determining that any one of the at least one switch is not triggered during the timing of the trigger duration while the trigger duration timed in sub-step A-2) has not reached the first predetermined length of time, repeating sub-step A-1).

3. The method of claim 2, wherein step A) further includes sub-steps of:

A-5) upon determining that any one of the at least one switch is not triggered in sub-step A-1), timing a non-trigger duration during which any one of the at least one switch is not triggered, and continuing to determine whether all of the at least one switch is triggered based on the first switch signal and the second switch signal received from each of the at least one switch during the timing of the non-trigger duration;

A-6) when the non-trigger duration timed in sub-step A-5) reaches a second predetermined length of time, determining that the striking condition is not met; and A-7) upon determining that all of the at least one switch is triggered during the timing of the non-trigger duration while the non-trigger duration timed in sub-step A-5) has not reached the second predetermined length of time, repeating sub-step A-1).

4. The method of claim 3, wherein sub-step A-1) is periodically performed at a predetermined time interval.

5. The method of claim 4, wherein each of the first predetermined length of time and the second predetermined length of time is greater than the predetermined time interval.

6. The method of claim 5, wherein the predetermined time interval is between 0.5 ms and 1.5 ms, the first predetermined length of time is between 15 ms and 25 ms, and the second predetermined length of time is between 15 ms and 25 ms.

7. An electric nail gun, comprising:

a gun body;

an electric power source unit mounted to said gun body and configured to provide electric power for operation of said electric nail gun;

a kinetic power unit mounted to said gun body, electrically connected to said electric power source unit for receiving the electric power therefrom, and configured to perform a nail-striking operation; and an electric control unit mounted to said gun body, and electrically connected to said electric power source unit and said kinetic power unit, said electric control unit including at least one switch, and a control module electrically connected to said at least one switch, wherein said control module has a flag that corresponds to said at least one switch;

wherein each of said at least one switch has a first node to output a first switch signal, a second node to output a second switch signal, and a common node operable to make electric connection with one of said first node and said second node, and is configured such that, when being triggered to make electric connection between said second node and said common node, the first switch signal has a first voltage and the second switch signal has a second voltage that is different from the first voltage;

wherein said control module receives the first switch signal and the second switch signal from each of said at least one switch, and is configured to perform the method of claim 1.

8. The electric nail gun of claim 7, wherein said at least one switch includes a first switch, and said electric nail gun further comprises a trigger unit pivotally mounted to said gun body, connected to said first switch, and operable to make said common node of said first switch electrically connect to one of said first node and said second node of said first switch.

9. The electric nail gun of claim 8, further comprising a safety unit to abut against an article;

wherein said at least one switch further includes a second switch, and said safety unit is connected to said second switch, and is operable to make said common node of said second switch electrically connect to one of said first node and said second node of said second switch.

10. The electric nail gun of claim 7, wherein said electric control unit further includes a pull-up circuit coupled to said at least one switch, and configured to provide the second voltage for said at least one switch.

11. The electric nail gun of claim 10, wherein said pull-up circuit includes, for each of said at least one switch, a first resistor connected between said first node and a voltage source that provides a second voltage, and a second resistor connected between said second node and the voltage source;

wherein said common node of each of said at least one switch is grounded; and wherein, for each of said at least one switch, said first node is a normally-closed node that is electrically connected to said common node when said at least one switch is not triggered, and said second node is a normally-open node that is electrically connected to said common node when said at least one switch is triggered.

* * * * *